US005710558A

United States Patent [19]

Gibson

[11] Patent Number: 5,710,558

[45] Date of Patent: Jan. 20, 1998

[54] TRAFFIC SENSOR FOR ROADWAY PLACEMENT

[76] Inventor: Guy P. Gibson, 76433 Alder St., Oakridge, Oreg. 97463

[21] Appl. No.: 585,702

[22] Filed: Jan. 16, 1996

[51] Int. Cl.[6] ..... G08G 1/01

[52] U.S. Cl. ..... 340/933; 340/939; 340/940; 340/941; 340/942; 340/665; 200/85 R; 200/86 A; 404/11; 404/22

[58] Field of Search ..... 340/933, 939, 340/940–943, 665, 666; 200/85 R, 85 A, DIG. 35; 404/9, 11, 22

[56] References Cited

U.S. PATENT DOCUMENTS

| | | | |
|---|---|---|---|
| 4,712,423 | 12/1987 | Siffert et al. | 73/146 |
| 4,762,970 | 8/1988 | Brinsley | 200/86 |
| 4,799,381 | 1/1989 | Tromp | 73/146 |
| 4,839,480 | 6/1989 | Bickley | 200/86 |
| 5,115,109 | 5/1992 | Fisher | 200/86 |
| 5,450,077 | 9/1995 | Tyburski | 340/933 |

*Primary Examiner*—Donnie L. Crosland
*Attorney, Agent, or Firm*—James D. Givnan, Jr.

[57] ABSTRACT

A traffic sensor for dispostion across a lane or lanes of a roadway includes a pliable strip within which is housed a flexible carrier which in turn supports electrical sensors and coaxial cables. The components are in circuit with a roadside located recording device. Vehicle imparted loads applied to the strip and carrier are counteracted by an inelastic member extending lengthwise of the strip to prevent erroneous electrical impulses. The inelastic is embodied in strands of material embedded in the carrier. Fastener elements extend through the strip for insertion into the roadway for strip retention.

10 Claims, 1 Drawing Sheet

TRAFFIC SENSOR FOR ROADWAY PLACEMENT

BACKGROUND OF THE INVENTION

The present invention concerns traffic sensors for placement across a lane or lanes for generating an electrical signal upon wheel passage.

In prior art, U.S. Pat. No. 5,450,077 discloses a roadway sensor comprising a flat elastomeric strip which includes a heavy metallic strip for retention on a roadway surface. Piezoelectric sensors and coaxial cables are carried within grooved areas of the elastomeric strip. In a modified form of the sensor the metallic strip may be grooved for reception of electrical components. The sensor, in one form, utilizes adhesive tape for securement of the metallic strip in place within a recessed area of the sensor. The sensor is for use on a multilane roadway for detecting lane traffic. Inclined surfaces along the sensor edges mitigate the impact of vehicle wheels. KEVLAR (™) strands 100 strengthen a portion of strip 80''' in FIG. 10.

U.S. Pat. No. 4,712,423 discloses a system for detecting loads imparted to a roadway by a vehicle as well as vehicle speed and includes the installation of two laterally spaced piezoelectric cables in place across a traffic lane with each of the cables embedded within a material such as silica epoxy mortar. A modified form of the sensor includes a superimposed structure for placement on a roadway surface.

U.S. Pat. No. 4,762,970 discloses an elongate, pressure actuated switch which may detect vehicle passage over a roadway with a switch structure including an outer sheath of polyurethane having a tubular body therein of electrically conductive material. A centrally disposed elongage conductor has an outer coating, normally spaced from the tubular body, and which, upon vehicle passage, is displaced into contact with tubular body 5 and thereby urging same into electrical contact with conductors extending along the outer wall of the tubular body.

U.S. Pat. No. 4,799,381 utilizes a metal channel for insertion within a highway lane groove with the channel containing a resilient strip in which is embedded conductive strips biased into pressured contact with one another during wheel contact with the resilient strip.

U.S. Pat. No. 4,839,480 discloses a sensor unit at 10 encapsulated in a water-resistant and abrasion-resistant elongate jacket 11 of elastomeric material. The sensor unit includes parallel conductors upon which a pressure conductive elastomeric matrix is superimposed and which, when biased by a vehicle wheel, increases in electric conductivity to generate a signal to one of the conductors. The sensor unit is embedded or encapsulated within an elongated jacket of polyurethane.

U.S. Pat. No. 5,115,109 discloses a strip component in place on a traffic lane with paired electrical contact means, normally spaced apart, and closing into contact through openings in a dielectric spacer between the contact means.

SUMMARY OF THE PRESENT INVENTION

The present invention includes an elastomeric strip for placement crosswise one or more traffic lanes for the purpose of generating electrical impulses upon being contacted by the wheels of a vehicle.

An elongate carrier, also of elastomeric material, is encapsulated in the strip and includes a member to prevent elongation of the carrier during wheel passage. The member is of inelastic construction. Grooved areas of the carrier, located subjacent the inelastic member, receive electrical components for signal generation and transmission. Accordingly, the electrical components are not subjected to tensioning forces during wheel passage and thereby avoid generation of erroneous impulses to a recording unit located adjacent the roadway. Retention means confines the present sensor in place against impact loads from vehicle wheels and may include fastener elements in engagement with the roadway surface.

Important objectives include the provision of a traffic sensor for placement across a traffic lane or lanes and including an elongate carrier in which is housed, in a protective manner, one or more electrical components protected from wheel imparted forces; the provision of a traffic sensor of elastomeric material with a component reinforced against elongation, during wheel passage, by the presence of an inelastic member to avoid erroneous signals which could be otherwise generated during such elongation; the provision of a traffic sensor which is of flexible construction and yet lending itself to securement in place along a roadway surface by inserted fastener elements.

DETAILED DESCRIPTION OF THE PREFERRED EMBODIMENTS

Figure 1:
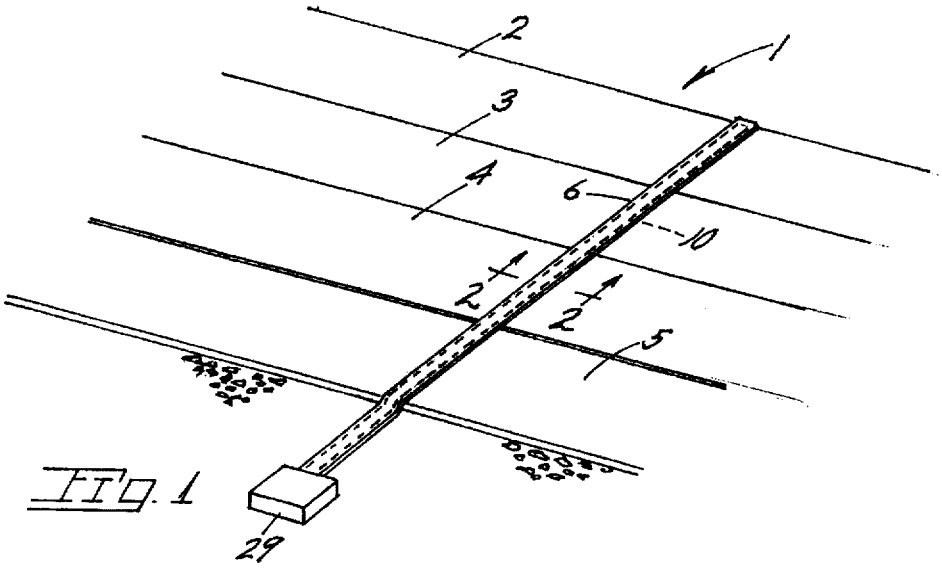
FIG. 1 is a perspective view of a multiple lane roadway with the present sensor disclosed thereon.

With continuing attention to the drawings, the reference numeral 1 indicates generally a portion of a roadway having traffic lanes indicated at 2, 3 and 4. A roadway shoulder is at 5. While a roadway with multilanes is shown, the present invention may be used for the sensing of traffic along a single lane as well.

An elastomeric strip 6 of the present sensor includes ramp surfaces 6A and 6B with a bottom wall indicated at 7 for placement on the roadway surface transversely over one or more lanes. Later described means may be utilized to secure the strip against displacement by vehicle wheels passing thereover.

An elongate carrier at 10 extends lengthwise of strip 6 in an embedded manner and isolating the carrier in a protective manner. The carrier 10 may be of rubber so as to flex with strip 6 and is preferably of a similar hardness rating as later noted. The carrier includes an inelastic component 11 with one suitable component being a polyester fiber impregnated with the carrier material an hence integral therewith. Inelastic material 11 retains the carrier against elongation in the presence of vehicle imparted loads and is protective of later described electrical components.

Figure 2:
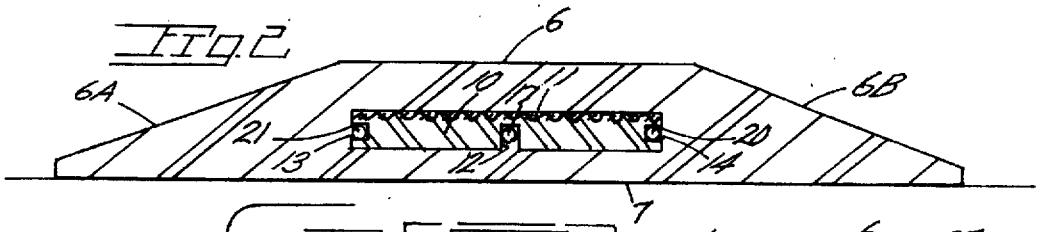
FIG. 2 is a vertical cross-sectional view of the traffic sensor.
Figure 3:
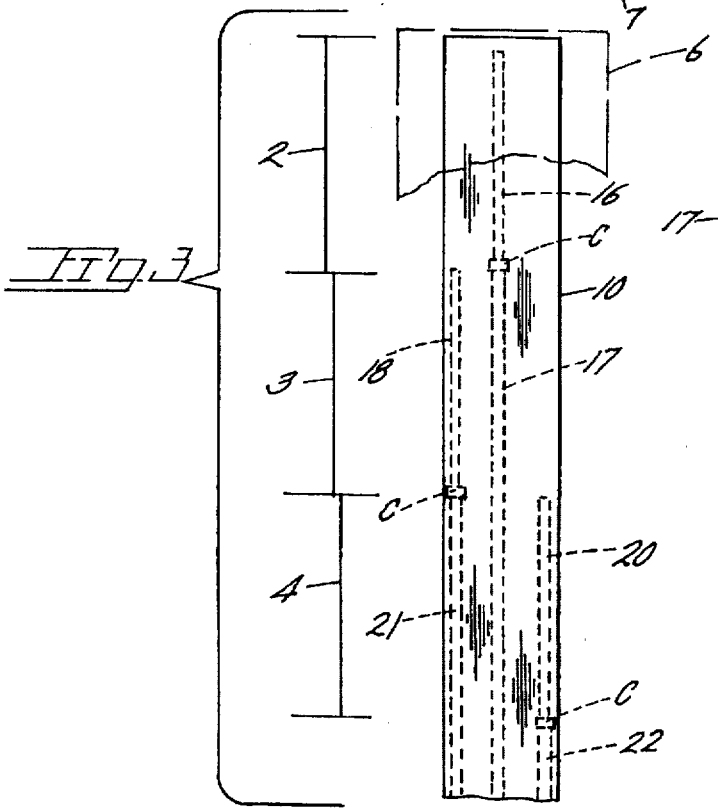
FIG. 3 is a schematic plan view of a segment of the traffic sensor.
Figure 4:
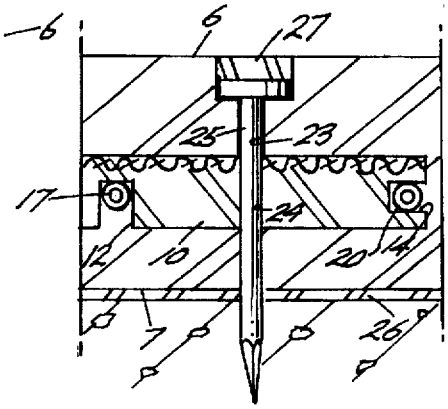
FIG. 4 is an enlarged fragmentary sectional view of an elongate reinforced carrier of the traffic sensor.

Carrier 10, in the embodiment shown in FIG. 2, defines lengthwise orientated grooves at 12, 13 and 14 in which are received electrical components of the present sensor. For example, groove 12 has a piezoelectric sensor cable 16 in that segment of groove subjected to loads imparted by the wheels of vehicles in lane 2. Groove 12 additionally receives in a snug manner a coaxial cable 17 suitably connected at C and conducting signals from sensor 16 to a counter at 29 located adjacent roadway 1. The present traffic sensor, as shown in the schematic of FIG. 2, is greatly out of proportion to traffic lanes 2,3 and 4.

In a traffic sensor strip 6 intended for use on multiple lane roadways piezoelectric sensors at 18 and 20 correspond to the width of traffic lanes 3 and 4 with the sensors each being in circuit via a coaxial cable at 21 and 22 each conducting a signal from their respective sensors 18 and 20 to counter 29.

Inelastic component 11 of carrier 10 protects subjacent piezoelectric sensors 16, 18 and 20 to the extent electrical impulses, otherwise resulting from tensioning of the sensors, are avoided.

For retention of strip 6 on a roadway, the strip as well as carrier 10 may define upright apertures 23–24 for the reception of fastener elements 25 for insertion into a roadway surface. Additionally strip securement may be enhanced by a butyl sealant at 26 between strip bottom 7 and the roadway surface. Such a sealant at 27 may be utilized to hold fasteners 25 in the sensor.

A suitable embodiment of the present invention includes a carrier formed from belting of styrene-butadene rubber of 3/16th of an inch thickness with a Durometer rating of 70. Inelastic component 11 may be of polyester strands woven into a fabric embedded into the carrier during manufacture. Strip 6 is of urethane resin with a shore hardness rating of A/B 80. A suitable piezoelectric sensor may be of the type manufactured by NTK Piezoelectric Ceramic Division of NGK Spark Plug Company, Ltd. of Japan.

In assembly of the present traffic sensor, elastomeric strip 6 is formed in an inverted manner within a mold. Carrier 10 is provided with the piezoelectric sensors and the connected coaxial cables installed in grooves 12, 13 and 14 to suit the intended application of the traffic sensor, i.e., whether for use on a roadway with one lane or use on a multilane roadway. Carrier 10 is subsequently embedded downwardly into inverted strip 6 and, in view of substantially equal densities of the material used for strip 6 and carrier 10, carrier 10 remains at the depth position in strip 6. During traffic sensor assembly the electrical components are frictionally held in place in a snug manner within their respective grooves.

Installation of a completed traffic sensor on a roadway includes the use of an adhesive material, as for example, double sided adhesive tape or a butyl sealant applied to surface 7 of the strip and the roadway surface. To further secure the traffic sensor in place, fastener elements 25 may be inserted within openings 23 and 24 formed in strip 6 and carrier 10. As the primary objective in such securement is prevention of lateral displacement, the fasteners 25 are especially effective to prevent same.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A traffic sensor for placement on a roadway having at least one traffic lane and comprising, an elastomeric strip for placement across the traffic lane, an elongate carrier of elastomeric material extending lengthwise of and embedded in said strip, said carrier including an inelastic component of woven strands of synthetic material, said carrier defining a groove subjacent said inelastic component and extending in a lengthwise direction of the carrier, an elongate electrical sensor occupying said groove and of the type actuated by a force imparted to said strip and the carrier by a wheel of a vehicle passing thereover to generate an electrical impulse, and a conductor in circuit with said sensor and terminating exteriorly of the elastomeric strip.

2. The sensor claimed in claim 1 wherein said inelastic component is embedded within said carrier and inhibits elongation of same.

3. The sensor claimed in claim 1 wherein said strip is of a length to extend across multiple traffic lanes, said carrier defines multiple open areas to receive additional sensors and conductors.

4. In a traffic sensor having an elastomeric strip for placement across a traffic lane of a roadway, an electrical component housed in said strip and responsive to forces exerted by a wheel of a vehicle passing over said strip, the improvement comprising an elongate carrier of elastomeric material embedded in the strip, said carrier having an integral non-metallic inelastic member inhibiting elongation of the carrier, an open area defined by the carrier extending lengthwise thereof and subjacent said inelastic member for the reception of said electrical component.

5. The invention claimed in claim 4 wherein said inelastic member is embedded in said carrier.

6. The invention claimed in claim 5 wherein said inelastic member is comprised of fibers.

7. The invention claimed in claim 5 wherein said inelastic component is comprised of polyester strands.

8. The invention claimed in claim 4 wherein said inelastic member includes a fabric of woven construction.

9. A traffic sensor for placement on a roadway having at least one traffic lane and comprising, an elastomeric strip for placement across the traffic lane, an elongate carrier of elastomeric material extending lengthwise of said strip and including a woven component, said carrier defining a groove subjacent said woven component and extending in a lengthwise direction of the carrier, a pressure actuated sensor in said open area and generating an electrical impulse upon a force being imparted to the carrier by a vehicle, and a conductor in circuit with said sensor and terminating exteriorly of the elastomeric strip for transmission of the impulse to a device monitoring vehicle travel.

10. The sensor/claimed in claim 9 wherein said woven component is embedded within said carrier and is of a synthetic fiber to inhibit elongation of the carrier and sensor carried therein.

* * * * *